US008851320B2

(12) United States Patent
Ramoo et al.

(10) Patent No.: US 8,851,320 B2
(45) **Date of Patent: *Oct. 7, 2014**

(54) STORAGE TANK CONTAINMENT SYSTEM

(71) Applicant: Altair Engineering, Inc., Troy, MI (US)

(72) Inventors: Regu Ramoo, Ashburn, VA (US); Mohan Parthasarathy, Macomb, MI (US); Thomas Lamb, Lynnwood, WV (US)

(73) Assignee: Altair Engineering, Inc., Troy, MI (US)

( * ) Notice: Subject to any disclaimer, the term of this patent is extended or adjusted under 35 U.S.C. 154(b) by 79 days.

This patent is subject to a terminal disclaimer.

(21) Appl. No.: 13/660,460

(22) Filed: Oct. 25, 2012

(65) Prior Publication Data

US 2013/0048513 A1 Feb. 28, 2013

Related U.S. Application Data

(63) Continuation of application No. 12/823,719, filed on Jun. 25, 2010, now Pat. No. 8,322,551, which is a continuation-in-part of application No. 11/923,787, filed on Oct. 25, 2007, now abandoned.

(60) Provisional application No. 60/854,593, filed on Oct. 26, 2006.

(51) Int. Cl.
*B65D 88/12* (2006.01)

(52) U.S. Cl.
USPC ..... 220/592; 220/654; 220/564; 220/651

(58) Field of Classification Search
CPC ..... B65D 88/10; B63B 25/08; F17C 1/08; F17C 1/002; F17C 1/005
USPC ..... 220/653, 652, 651, 4.14, 4.12, 563, 220/564, 565, 592, 654
See application file for complete search history.

(56) References Cited

U.S. PATENT DOCUMENTS

| | | | | |
|---|---|---|---|---|
| 1,965,455 | A | | 7/1910 | Harry |
| 1,769,831 | A | | 7/1929 | Gramm |
| 2,675,940 | A | | 4/1954 | Ewald |
| 3,124,265 | A | | 3/1964 | Bertels |
| 3,314,567 | A | | 4/1967 | Becker et al. |
| 3,414,153 | A | * | 12/1968 | Leroux ..... 220/565 |
| 3,944,106 | A | | 3/1976 | Lamb |
| 4,459,929 | A | | 7/1984 | Ffooks |
| 4,838,449 | A | | 6/1989 | Jarnott et al. |
| 4,946,056 | A | * | 8/1990 | Stannard ..... 220/584 |
| 4,947,998 | A | | 8/1990 | Smeller |
| 5,462,505 | A | | 10/1995 | Blair et al. |
| 5,624,049 | A | | 4/1997 | Kovash et al. |

(Continued)

FOREIGN PATENT DOCUMENTS

WO WO2006001711 A2 1/2006

OTHER PUBLICATIONS

Written Opinion and Search Report dated Mar. 26, 2013 from related PCT/US2010/066073 filed Nov. 20, 2012.

*Primary Examiner* — Stephen Castellano
(74) *Attorney, Agent, or Firm* — Young Basile

(57) ABSTRACT

A storage tank containment system including a cubic-shaped tank having an outer shell having cylindrical walls for the efficient storage and transportation of large quantities of fluid, for example, liquid and compressed natural gas.

18 Claims, 10 Drawing Sheets

(56) References Cited

U.S. PATENT DOCUMENTS

| | | | | |
|---|---|---|---|---|
| 6,659,303 | B2 | 12/2003 | Garceau | |
| 6,691,889 | B1 | 2/2004 | Falk | |
| RE41,142 | E | 2/2010 | Blair et al. | |
| 8,322,551 | B2 * | 12/2012 | Ramoo et al. | 220/4.12 |
| 2001/0040160 | A1 | 11/2001 | Gulati | |
| 2008/0209918 | A1 | 9/2008 | White | |
| 2010/0083671 | A1 | 4/2010 | Liner | |
| 2011/0121003 | A1 | 5/2011 | Moir | |

* cited by examiner

STORAGE TANK CONTAINMENT SYSTEM

CROSS REFERENCE TO RELATED APPLICATIONS

This application is a continuation of and claims priority benefit to application Ser. No. 12/823,719 filed Jun. 25, 2010, now U.S. Pat. No. 8,322,551, which is a continuation-in-part of and claims the benefit of Ser. No. 11/923,787 filed Oct. 25, 2007, now abandoned, which claims priority to provisional patent application Ser. No. 60/854,593 for a STORAGE TANK FABRICATION, filed on Oct. 26, 2006, all of which are incorporated herein by reference.

FIELD OF THE INVENTION

The invention generally pertains to storage tanks and more particularly to storage tanks for fluids including liquids and gases.

BACKGROUND

Industrial storage tanks used to contain liquids or compressed gases are common and are vital to industry. Storage tanks may be used to temporarily or permanently store fluids at an on-site location or may be used to transport the fluids over land or sea. Numerous inventions in the structural configurations of fluid storage tanks have been made over the years. One example of a non-conventional fluid storage tank having a cube-shaped configuration and support structure is found in U.S. Pat. No. 3,944,106 to Thomas Lamb, the entire contents of the patent are incorporated herein by reference.

There has been a progressive demand for the efficient storage and long distance transportation of fluids such as liquid natural gas (LNG), particularly over seas by large ocean-going tankers or carriers. In an effort to transport fluid such as LNG more economically, the holding or storage capacity of such LNG carriers has increased significantly from about 26,000 cubic meters in 1965 to over 200,000 cubic meters in 2005. Naturally, the length, beam and draft of these super carriers have also increased to accommodate the larger cargo capacity. The ability to further increase the size of these super carriers, however, has practical limits in the manufacture and use.

Difficulties have been experienced in the storage and transportation of fluids, particularly in a liquid form, through transportation by ocean carriers. A trend for large LNG carriers has been to use large side-to-side membrane-type tanks and insulation box supported-type tanks. As the volume of the tank transported fluid increases, the hydrostatic and dynamic loads on the tank containment walls increase significantly. These membrane and insulation type of tanks suffer from disadvantages of managing the "sloshing" movement of the liquid in the tank due to the natural movement of the carrier through the sea. As a result, the effective holding capacity of these types of tanks has been limited to either over 80% full or less than 10% full to avoid damage to the tank lining and insulation. The disadvantages and limitations of these tanks are expected to increase as the size of carriers increase.

The prior U.S. Pat. No. 3,944,106 tank was evaluated for containment of LNG in large capacities, for example, in large LNG ocean carriers against a similar sized geometric cube tank. It was determined that the '106 tank was more rigid using one third the wall thickness of the geometric cube. The '106 tank further significantly reduced the velocity of the fluid, reduced the energy transmitted to the tank and reduced the forces transmitted by the fluid to the tank causing substantially less deformation of the tank compared to the geometric cubic tank.

It was further determined, however, that the '106 configured tank did not prove suitable to handle large capacities of LNG in a large LNG carrier environment.

A further need has developed for the efficient storage and transportation of compressed natural gas (CNG) over land and sea. This includes carriers as well as Floating Oil/CNG Processing and Storage Offshore Platforms (FOCNGPSO) and floating CNG Processing and Storage Offshore Platforms (FCNGPSO). Several systems have been developed including the EnerSea Transport LLC's VOTRANS (a trademark of EnerSea) system which includes thousands of vertical or horizontal pipes which are individually filled with CNG and arranged in modules, for example on an ocean tanker. Another example is a system by SEA NG Company which involves miles of continuous piping oriented in a horizontal coil or reel called a COSELLE (a trademark of SEA NG). These self-contained coselles can be stacked vertically on one another and positioned in a tanker storage hold.

These CNG systems suffer from several disadvantages in managing the high pressure that CNG is typically stored at which can range from 2000-4000 pounds per square inch (psi) and at temperatures between around 0 and minus 30 degrees Centigrade (−30° C.). Some of these disadvantages of prior CNG storage systems include complexity in the storage tanks or systems themselves as well as significant requirements in the carrying vessel's length, beam, tonnage, propulsion, fuel consumption and the number of storage tank manifolds needed to maintain the desired temperature and pressure of the stored CNG.

Therefore, it would be advantageous to design and fabricate storage tanks for the efficient storage and transportation of large quantities of fluids such as LNG or CNG across land or sea. It is further desirable to provide a storage tank that is capable of being fabricated in ship yards for large tankers that further minimizes the number of components and minimizes the different gages or thickness of materials that are needed for the tank. It is further advantageous to provide a modular-type tank design which facilitates design, fabrication and use in the field.

SUMMARY

The inventive storage tank containment system includes a six-sided generally cube-shaped outer shell and an internal cross-brace interconnecting at least five of the six sides of the storage tank.

In one example, the outer shell of the tank includes twelve substantially identical cylindrical-shaped walls interconnected to one another at opposing edges. The outer shell further includes eight spherical-shaped end caps closing the corners of the cube-shaped tank. The internal cross brace structurally reinforces the cylindrical walls and further distributes the loads due to containment and movement of the fluid contents.

In an alternate example, a different internal cross brace is used which includes a structurally reinforced column, angularly opposed side brackets and end reinforcements.

In another alternate example, cross brace side extensions are used with the internal cross brace along with a base plate to transfer and support the loads of the tank to the fore, aft and transverse bulkheads and tank top of the cargo hold, for example, in a large ocean carrier.

The particular design of the tank base support and extensions provides advantages to support the weight of the tank and its contents and to laterally position the tank center at the same location as the tank thermally contracts, for example, as the low temperature liquid is loaded into it. Above each slot, a locking plate may be provided to prevent the extension from moving out of the mounting slot in a ship due to motion in heavy seas.

In an alternate example particularly useful for CNG, a generally cube-shaped tank is provided with cylindrical sidewalls without the need for an internal cross brace at the center of the tank structure. In alternate examples, an internal bulkhead reinforcement is used for structural fortification of the tank.

Other applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DETAILED DESCRIPTION

Figure 1:
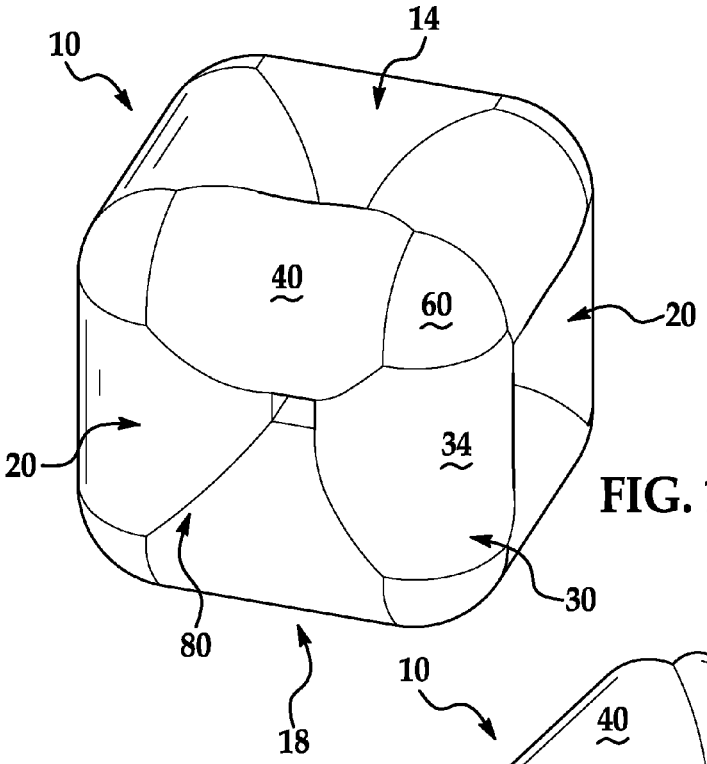
FIG. 1 is schematic perspective view of an example of a stand alone tank containment system.
Figure 2:
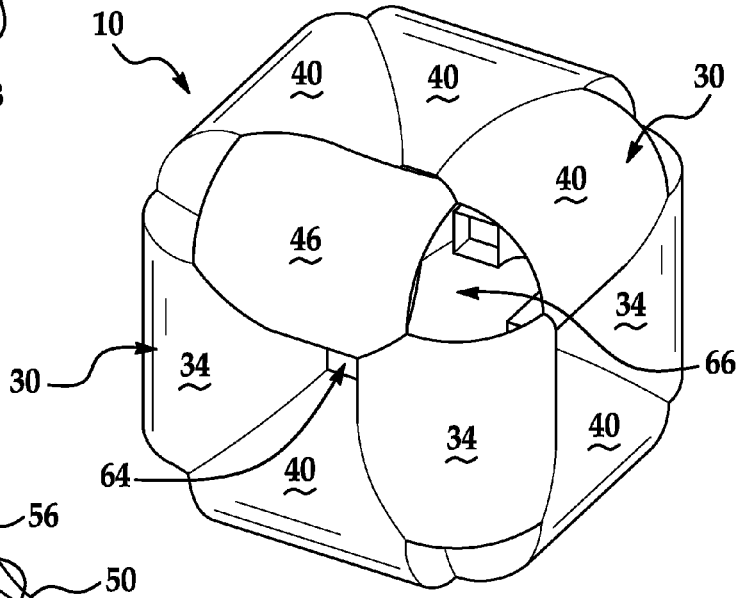
FIG. 2 is partial schematic of the tank in FIG. 1 with the exemplary spherical end caps removed showing part of the internal tank.

Several examples of the storage tank containment system in exemplary uses are shown in FIGS. 1-25. Referring to FIGS. 1 and 2, the containment system includes a storage tank 10 having a generally six-sided cubic configuration. Tank 10 includes twelve independent, substantially identical cylindrical walls 30. The cylindrical walls 30 are arranged to include four vertical cylindrical walls 34 and eight horizontal cylindrical walls 40 generally arranged and configured as shown in FIG. 2. The cylindrical walls 30 form an outer shell of tank 10 having six sides including a top side 14, bottom side 18 and four intermediate sides 20. The combined cylindrical walls define an interior storage chamber 66 for containment of materials or preferably fluids including liquids and/or gases maintained at or above atmospheric pressure.

Figure 3:
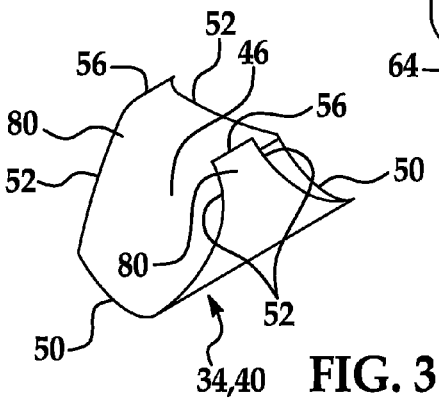
FIG. 3 is a perspective view of one cylindrical wall component of the tank in FIG. 2.

As best seen in FIG. 3, each cylindrical wall 30 includes a cylindrical-shaped center portion 46 having first ends 50, adjacent edges 52 and second ends 56. As shown in FIG. 2, each cylindrical wall 30 interconnects with four adjacent cylindrical walls through edges 52. In one preferred example of the construction of tank 10, localized regions 80, where the cylindrical walls 30 connect to each other, may be constructed of a higher gage wall thickness. Similarly the remainder of the cylindrical walls 30 may be constructed of lower gage plating. This may be accomplished through tailor-welded blanks or other manufacture or assembly methods known by those skilled in the art.

In one preferred example shown in FIG. 1, eight end caps 60 are used to sealingly close the eight corners of the cube-shaped tank 10. End caps 60 are spherical in shape and complimentary to the shape and orientation of the three adjacent cylindrical walls 30, namely, two horizontal cylindrical walls 46 and a vertical cylindrical wall 34. In this configuration, the cylindrical walls 30 form a tank side opening 64 on each of the six sides of tank 10. One or more entry ports (not shown) to access the interior storage chamber 66 may be used to efficiently fill, extract and monitor the tank contents.

Figure 4:
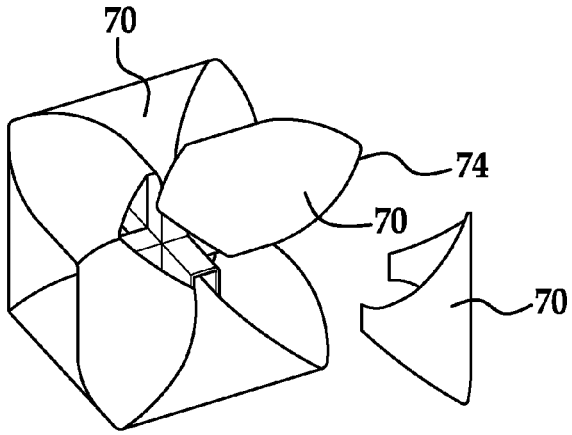
FIG. 4 is a partial exploded view of an alternate example of the tank shown in FIG. 2 where the spherical ends caps are deleted.

Referring to FIG. 4, an alternate example of the outer shell of tank 10 is shown. In this example, each of the alternate cylindrical walls 70 includes corner portions 74 eliminating the need for end caps 60 shown in FIG. 1.

Figure 5:
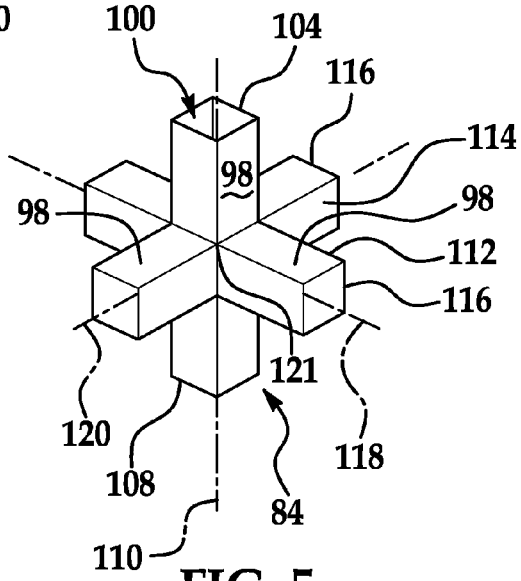
FIG. 5 is a perspective view of one example of an internal cross brace.

Referring to FIG. 5, tank 10 includes an internal cross brace 84. Internal cross brace 84 generally includes six brackets 98 angularly orientated with respect to one another for preferable connection to each of the six sides of tank 10 defined by cylindrical walls 30 as more fully described below. The two vertical oriented brackets 98 form a column 100 having an upper end 104 and lower end 108 defining a first axis 110. Brackets 98 forms a first side brace 112 defining a second axis 118 and a second side brace 114 defining a third axis 120. The first, second and third axes meet at a center point (not shown). In a preferred example, the center point is positioned at approximately the center of gravity of the tank 10. Internal cross brace 84 is positioned between the six sides of tank 10 exterior to the internal storage chamber 66 containing the preferred fluid. The internal cross brace 84 can be either tubular or a built up I-beam cross section (not shown).

Internal cross brace 84, and more particularly the four ends 116 on the first side brace 112 and second side brace 114 are connected to cylindrical walls 30 at the side openings 64 on each of the four sides, and top and bottom as best seen in FIG. 5. The rigid structural connections between each cylindrical wall 30 and internal cross brace 84 provide a significantly more robust, structurally reinforced tank 10 over prior tanks.

In a preferred example of materials for exemplary tank 10 shown in FIGS. 1-3 and 5, cylindrical walls 30, end caps 60, and internal cross brace 84 are all manufactured from nickel steel and have varying gage or thickness which is dependent upon the location of the plating, size and anticipated contents of the tank to suit the anticipated stresses in the plating or tank components. The respective components may be connected together through continuous seam welds along all connecting joints for strength and sealability of the tank. It is understood that different materials, gages and methods of connection known by those skilled in the art may be used.

In an exemplary design as generally shown in FIGS. 1 and 2 with an internal cross brace substantially as shown in FIG. 5, a suitable construction of a tank 10 may have the following characteristics. For a very large tank, for example an ultra-large LNG ocean carrier, a tank measuring approximately 36.6 meters each in length, width and height may be used. The tank may be manufactured from nickel steel with a modulus of 210,000 MPa and a poisson ratio of 0.3. Other materials may be used to form tank 10 including aluminum or selected steels. The contents may be liquid natural gas (LNG) having a specific gravity of 0.5 occupying approximately 95% of the tank 10 usable volume. In this example, analytical testing indicated areas of higher stress in the tank 10 at the joints of the cylindrical walls 30 and region 80 of the cylindrical walls 34 and 40 due to hydrostatic pressure loads on the tank.

Figure 6:
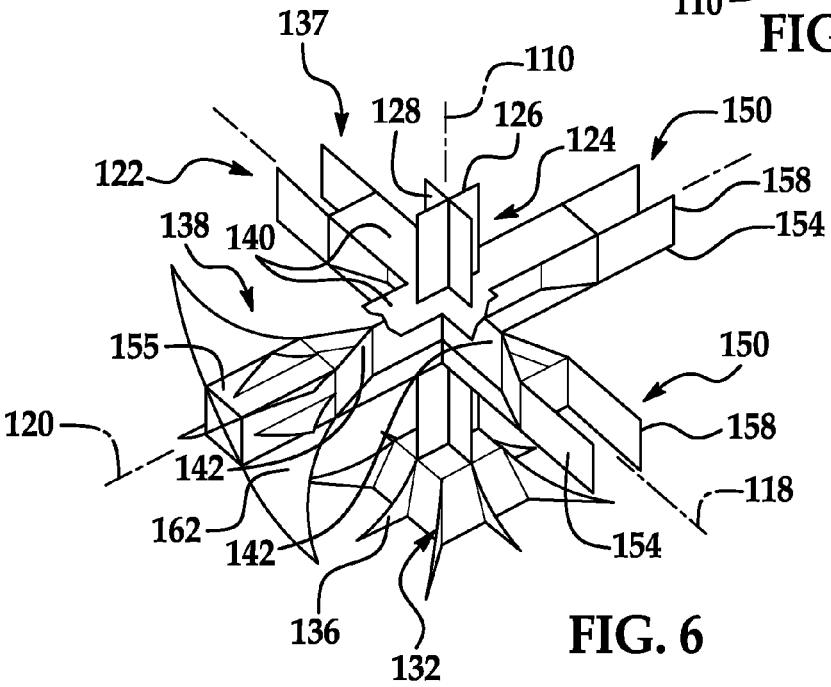
FIG. 6 is a perspective view of an alternate example of an internal cross brace.

In a preferred alternate example of tank 10, as best seen in FIGS. 2 and 6-13, alternate tank 10 design includes an alternate cross brace 122 and side reinforcements 162. This alternate design discloses exemplary ways for increasing the stress capabilities of the tank and connecting the internal cross brace to an exemplary carrier hull structure. Referring to FIGS. 2 and 6, the alternate tank 10 includes twelve substantially identical cylindrical walls 30 and end caps 60 as previously described. The alternate cross brace 122 comprises of a column 124 including a first wall 126 and second wall 128 positioned approximately perpendicular to one another defining a first axis 110. Cross brace 122 further includes a base 132 and base reinforcements 136 connected to the lower portion of column 124. Internal cross brace 122 further includes an alternate first brace 137 and a alternate second brace 138 defining a second axis 118 and a third axis 120 respectively. The first, second and third axes converge at a center point as previously described.

In the preferred example, each of the first 137 and second 138 braces include top and bottom plate 140 and an inner wall 142 as generally shown. Inner wall 142 may form two separate inner walls as shown.

Figure 9:
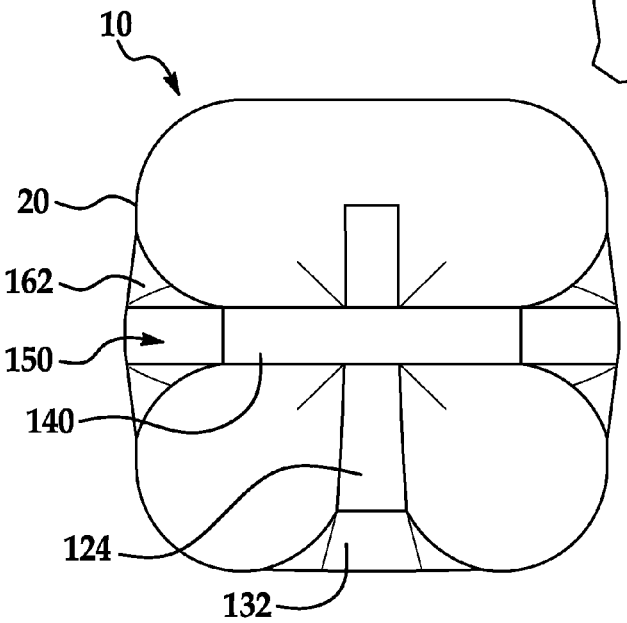
FIG. 9 is a partial cut-away side view of the alternate tank and cross brace shown in FIG. 7.
Figure 10:
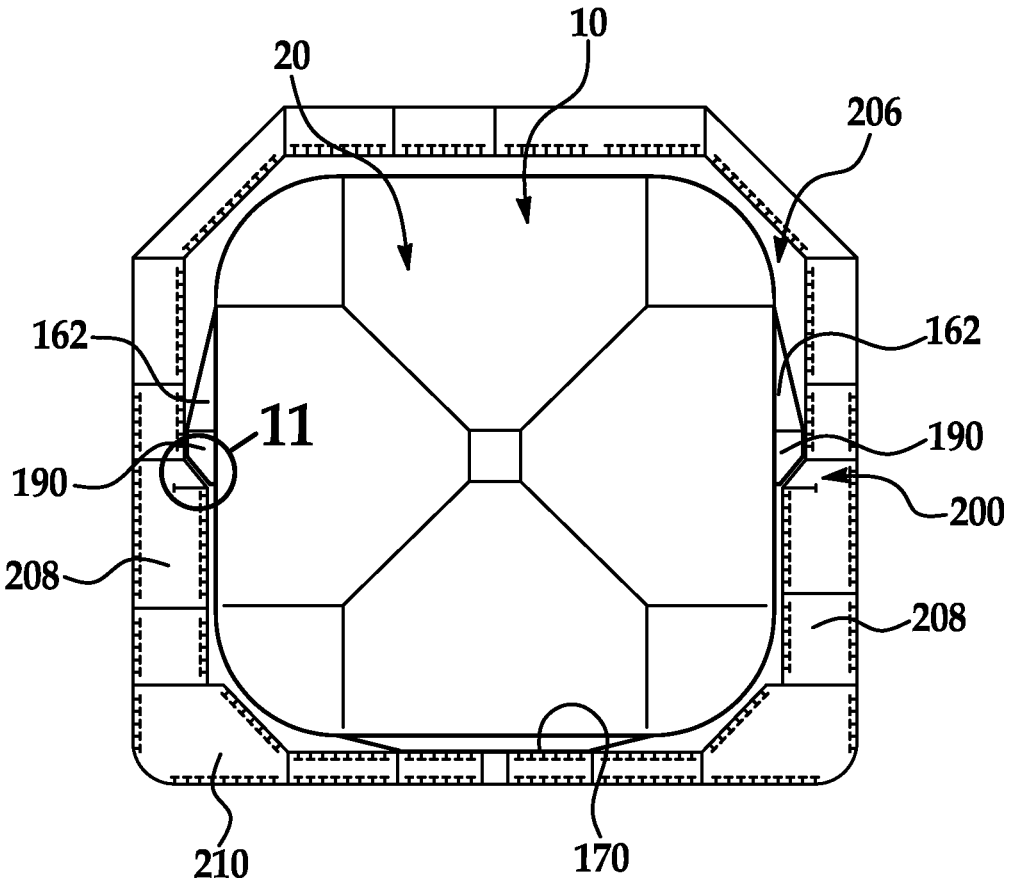
FIG. 10 is a schematic side view of the tank shown in FIG. 7 installed in a marine vessel cargo hold area.
Figure 11:
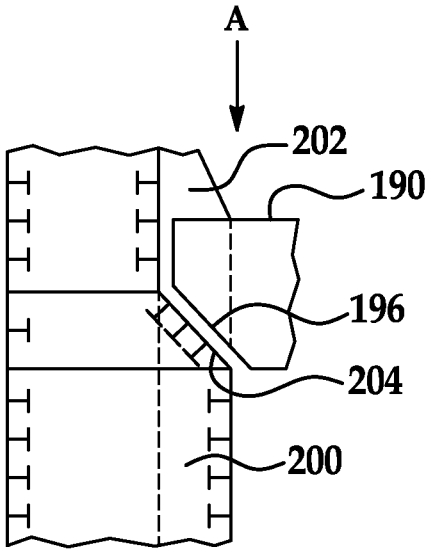
FIG. 11 is an enlarged view of a portion of FIG. 10.
Figure 12:
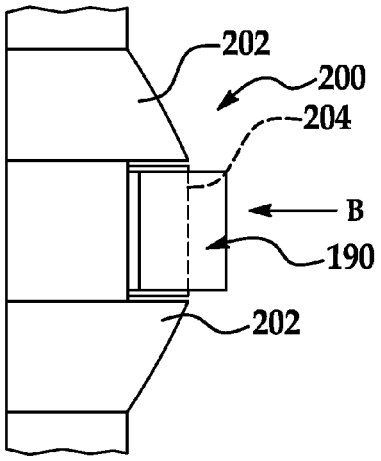
FIG. 12 is a partial top view of the storage tank shown in FIG. 10 as viewed from direction A in FIG. 11.
Figure 13:
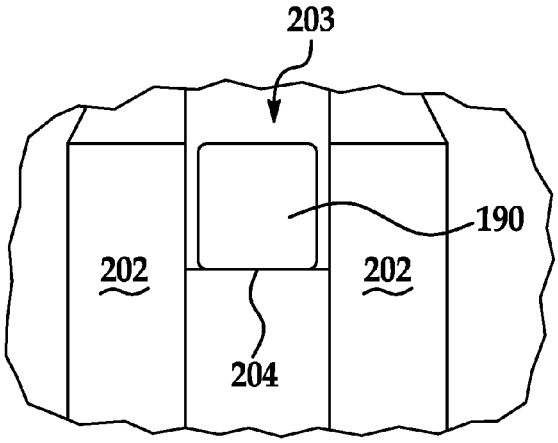
FIG. 13 is a schematic side view taken from the view of arrow B in FIG. 12 showing the side extension positioned in a slot in a cargo hold.

In a preferred example, each of the first 137 and second 138 braces may include an extension 150 extending axially outward from inner wall 142 along second 118 and third 120 axes. Extensions 150 may each include a pair of side walls 154 and top and bottom plates 155 extending axially outward from inner wall 142 terminating at ends 158. As shown in FIGS. 6 and 9, extension 150 may project slightly beyond tank side 20 for connection of tank 10 to the inner walls of a cargo hold as further described below.

Figure 7:
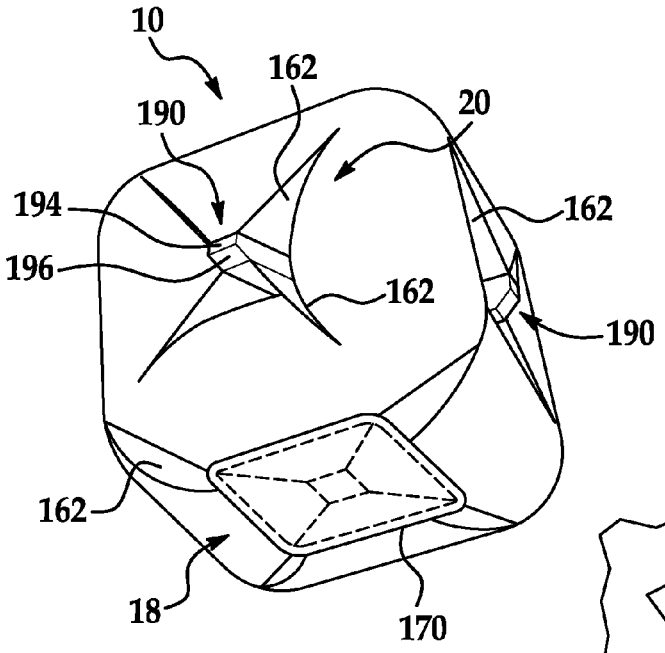
FIG. 7 is a schematic perspective view of an alternate storage tank containment system with an alternate cross brace and cross brace side extensions.

In a preferred examples shown in FIGS. 6, 7 and 9, on each of the four sides 20 of tank 10, four alternate side reinforcements 162 are rigidly attached to extensions 150 and project axially and radially outward from second 118 and third 120 axes to substantially compliment the curved outer surfaces of the cylindrical walls 30 as best seen in FIG. 7. Base 132 of column 124 and reinforcements 136 serve to reinforce the bottom 18 of tank 10.

Figure 8:
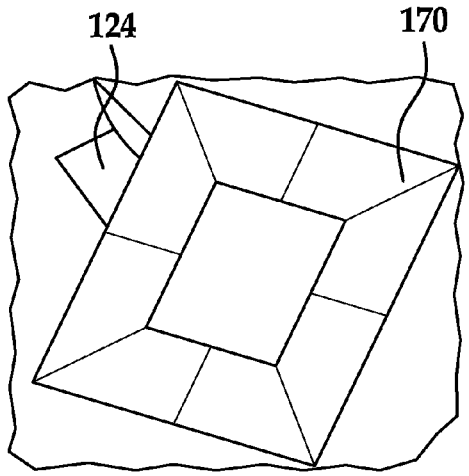
FIG. 8 is a schematic perspective view of the bottom side of the tank shown in FIG. 7.

Referring to FIG. 8, alternate tank 10 may include a base plate 170 used to structurally connect tank 10 to the floor or hull of a cargo hold in an ocean carrier or other transportation device. In the example, cross brace base column 124, base 132 and base reinforcements 136 are rigidly connected to base plate 170. These structures, along with side reinforcements 162 on bottom 18, provide vertical and lateral support of tank bottom 18 and tank 10 in an exemplary cargo hold of a large LNG ocean carrier.

Referring to FIGS. 7, 9-12 an alternate internal cross brace 122 side extension 190 is shown differing from extensions 150 shown in FIG. 6. In the example, alternate side extensions 190 include a bevel 196 preferably facing toward the bottom 18 of the tank 10 and are rigidly connected to end reinforcements 162 as previously described. Alternate side extensions 190 are preferably located in a slot 203 in cargo hold bulkhead 200 defined by bulkhead sides 202, angled support surface 204 and hull side 208. Bulkhead 200, sides 202, and an angled support surface 204, allow the tank lateral extensions 190 to slide down the bulkhead sloped surface 204 (gap shown between 196 and 204 for purposes of illustration only) to accommodate any reduction in tank size due to thermal contraction, for example when cold fluids are loaded in to the tank. A vertical locking plate (not shown) may be positioned above extensions 190 in slot 203 to prevent vertical movement of extension 190 once installed. Alternatively, extensions 190 may be securely attached to the bulkheads or hull.

Figure 14:
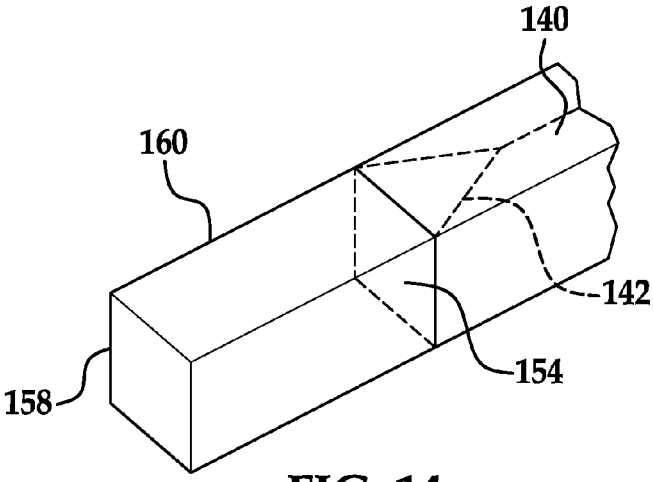
FIG. 14 is a perspective view of an alternate example of the side extensions shown in FIG. 7.

Referring to FIG. 14, an alternate side extension of internal cross brace 122 is shown. In the example, walls 154, as shown in FIG. 6, are illustrated. In addition, a reinforcement 160 is added axially extending from end 144 to attach to a hull or cargo hold bulkhead as previously described.

Figure 15:
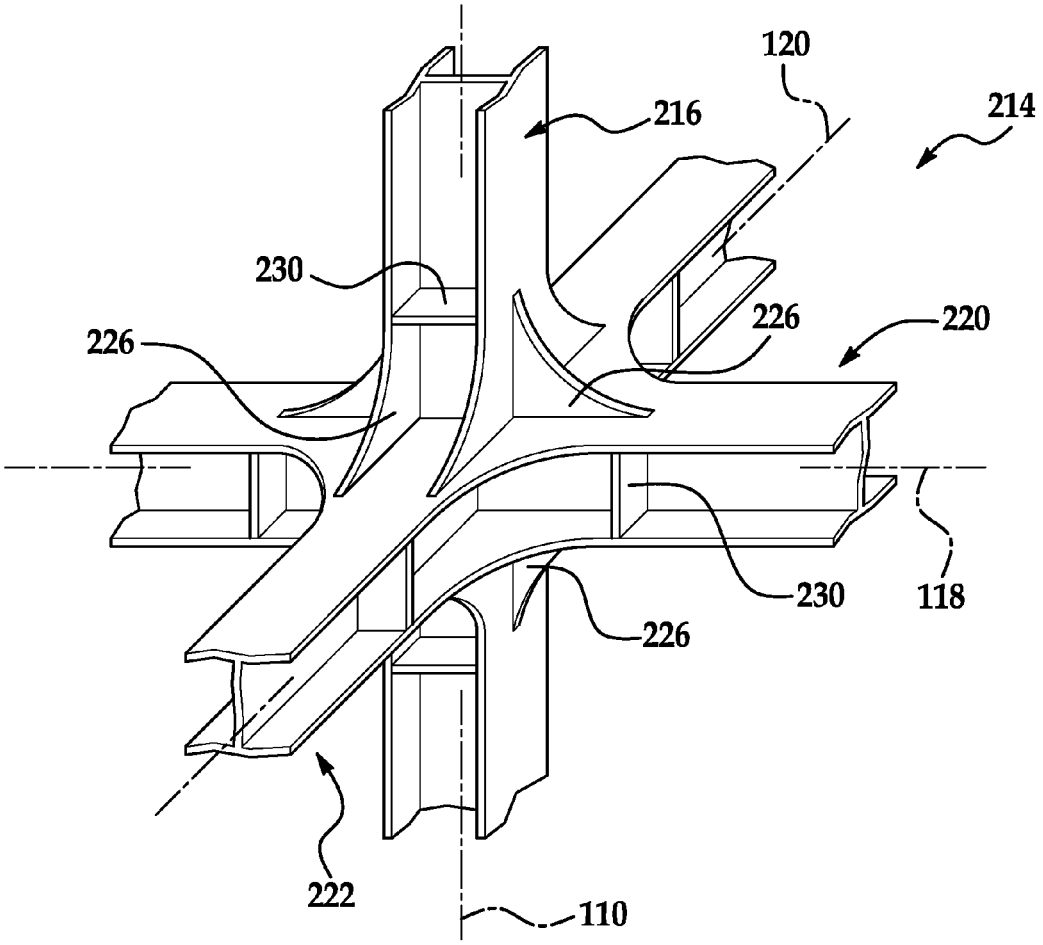
FIG. 15 is a schematic perspective view of an alternate internal cross brace.
Figure 16:
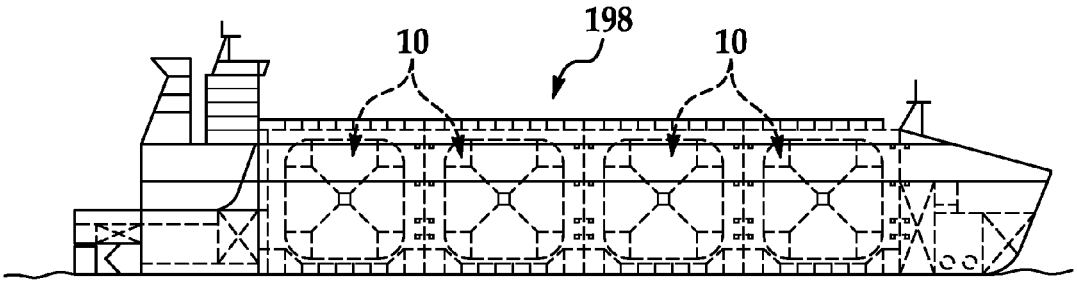
FIG. 16 is a schematic side view of an example of an ultra-large LNG carrier with four storage tanks positioned in respective cargo holds.

Referring to FIG. 15, an alternate internal cross brace 214 is illustrated. Alternate cross brace 214 preferably includes a column 216, a first side brace 220 and a second side brace 222. Similar to FIG. 6, cross brace 214 includes first 120, second 118 and third 120 axes. As generally illustrated, cross brace 214 includes a general I-beam construction and connects to the six sides of the tank 10 (not shown) in a similar method as previously described. Cross brace 214 preferably includes several reinforcement gussets 226 (six shown in FIG. 15) and plates 230 (six shown) to reinforce the I-beam column, side braces and cross brace as generally shown. Cross brace 214 may further connect to the hull or bulkheads of a transportation vehicle in a manner as further described below Referring to FIGS. 10-13, tank 10 in an exemplary use in a large LNG carrier, may be positioned in a cargo hold or cargo bay area 206 of a carrier vessel 198 or other transportation vehicle. In the preferred example, tank 10 is pre-fabricated and lowered by crane into, or is integrally built into, a cargo hold 206. Tank 10 is vertically supported by base plate 170 which rests on the cargo floor. Cross brace side extensions 190, including preferred beveled 196, are positioned between bulkhead sides 202 and placed in supporting contact with bulkhead surface 204 to lock the tank in a lateral position even as the tank overall dimensions vary with varying cargo temperature. This support and securing design substantially eliminates the need for any mechanical connection. In this position, tank 10 is supported vertically and laterally in cargo hold 206 for receipt and containment of a solid or fluid, for example LNG, for transportation over land or sea. The structural container tank 10 may be filled with, for example, LNG in a range from empty up to about 95 percent of the capacity of internal storage chamber 66.

The tank 10 may be filled with, for example, LNG to a capacity of about 95 percent of the internal storage chamber 66. As shown in the chart below, the volumetric efficiency of a tank 10 design (the CDTS) is compared with prior tank designs and a proposed PRISM membrane tank system (Nobel 2005). Comparing the tanks to a solid cube of 49,108 cubic meters, the respective volumes and efficiencies are shown.

TABLE 1

COMPARISON OF TANK VOLUMETRIC EFFICENCY

| Tank Type | Volume | Efficiency |
|---|---|---|
| Prismatic Self-Standing | 46,162 | 0.94 |
| Membrane | 43,706 | 0.88 |
| Membrane PRISM | 38,304 | 0.78 |
| CDTS | 40,000 | 0.8145 |
| Sphere | 25,713 | 0.5236 |

The table shows that the tank 10 (CDTS) is 60% more efficient than a comparable spherical tank and an improvement over the PRISM tank design.

Further, use of a large marine carrier or ship cargo space was also compared. The below table shows the cargo hold space required by each of the below tank designs compared for a 138,000 and 400,000 cubic meter carrier. The numbers in parentheses show the percentage comparison with a membrane tank-type lining system.

TABLE 2

COMPARISON OF HOLD SPACE REQUIRED BY PRISMATIC, MEMBRANE, SPHEREICAL AND CDTS

| | Length | Breadth | Depth To Cover | Space Usage |
|---|---|---|---|---|
| | CAPACITY 138,000 $m^3$ | | | |
| Prismatic Self Standing | 176 (95) | 44 (100) | 35 (103) | 0.51 (106) |
| Membrane Original | 186 (100) | 44 (100) | 34 (100) | 0.48 (100) |
| Spherical | 192 (103) | 48 (109) | 43 (126) | 0.35 (73) |
| CDTS | 168 (90) | 41 (93) | 41 (121) | 0.49 (102) |
| | CAPACITY 400,000 $m^3$ | | | |
| Prismatic Self Standing | 240 (94) | 64 (100) | 49 (102) | 0.53 (104) |
| Membrane Original | 255 (100) | 64 (100) | 48 (100) | 0.51 (100) |
| Spherical | 285 (138) | 67 (105) | 57 (119) | 0.37 (73) |
| CDTS | 230 (94) | 58 (91) | 58 (121) | 0.52 (102) |

The table shows that there are significant size reductions and an increase in percentage of use attainable in a large marine carrier using tank 10 over certain tank systems.

In a preferred example and method of fabrication, the respective components of alternate tank 10 shown in FIGS. 6-13, are preferably fabricated from nickel steel from substantially varying gage suitable for the application and are seam welded as previously described. It is understood that tank 10 maybe fabricated in different sizes, and be fabricated and assembled using alternate material and attachment techniques suitable for the particular contents and application.

The tank 10 includes numerous other advantages over prior tanks. Exemplary advantages of tank 10 include: flexibility on the amount of fluid contained ranging from about 5 to about 95 percent of the tank capacity; there is no need to stage the cargo hold to apply insulation and lining to the cargo hold; there is no need for significant welding of the insulation and lining securing strips and the lining onboard a ship; the tank 10 can be installed in one piece at the most efficient time in the ship production process; tank 10 can be constructed of different materials and is modular in design; tank 10 can be produced at many ship and transportation vehicle build sites using conventional tools; tank 10 can be leak tested before installation in a ship or transportation vehicle; tank 10 is not subject to the level of damage from dropped items as compared to membrane tank containment systems and tank 10 requires a smaller base support "foot print" compared to spherical tanks circumferential skirts. Other advantages known by those skilled in the art may be achieved.

Figure 17:
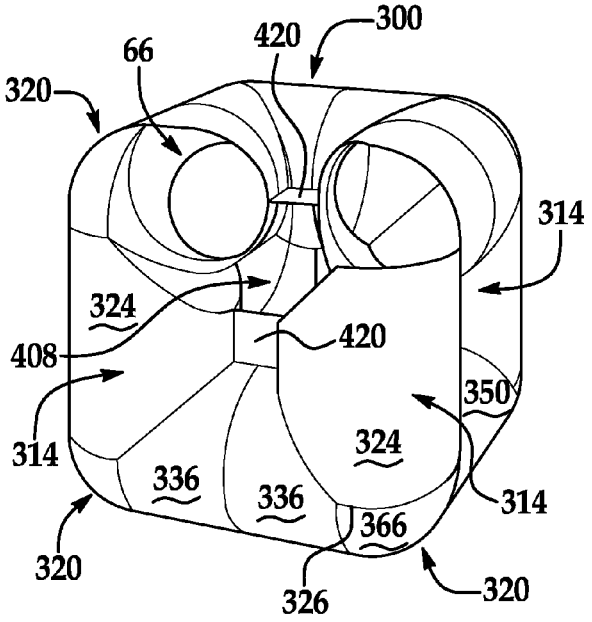
FIG. 17 is a schematic, partially cut-away perspective view of an example of an alternate storage tank with exemplary spherical corners useful for CNG applications.
Figure 18:
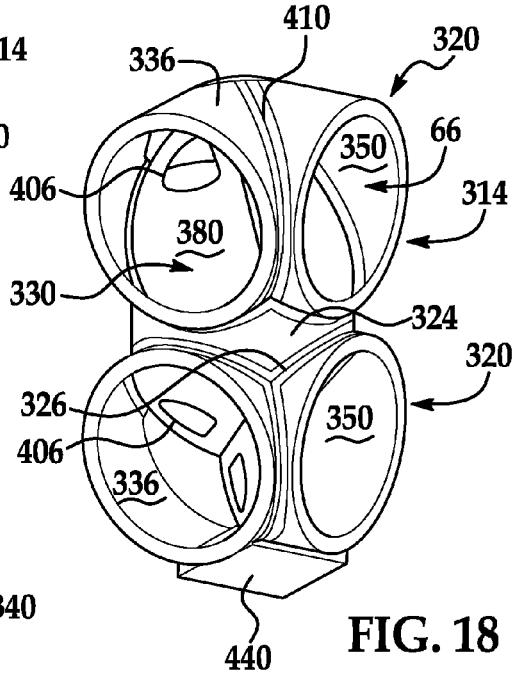
FIG. 18 is a partial perspective view of one portion of the tank illustrated in FIG. 17.
Figure 19:
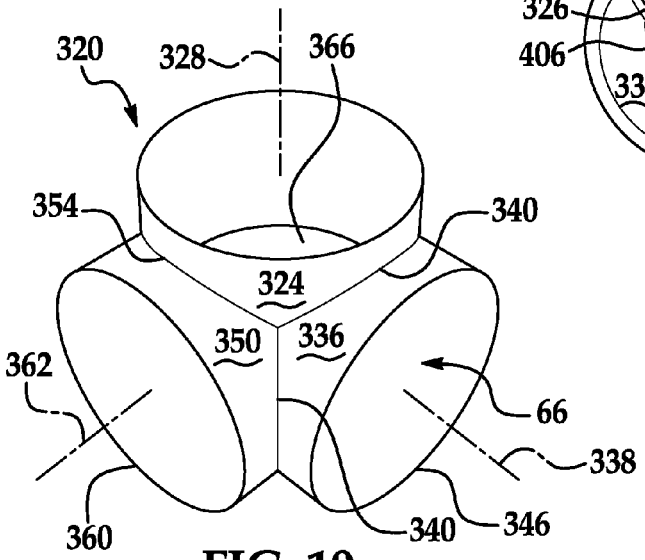
FIG. 19 is a partial perspective view of a corner portion of the tank illustrated in FIG. 18.
Figure 20:
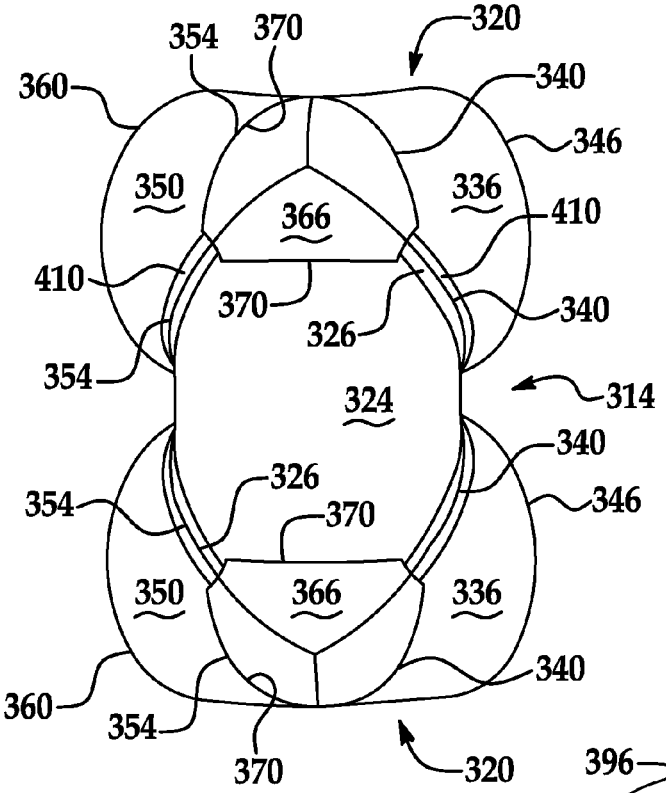
FIG. 20 is an external elevational view of a quarter of the tank shown in FIG. 17.
Figure 21:
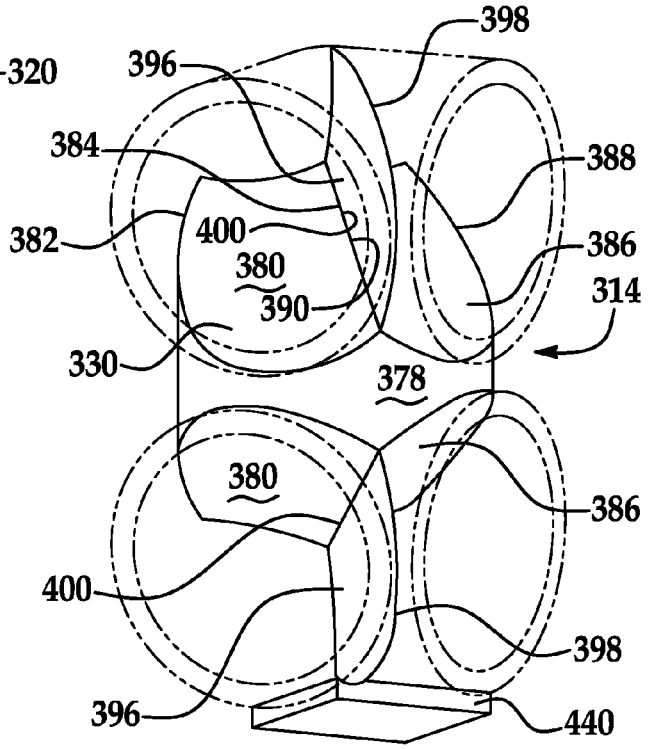
FIG. 21 is an alternate view of the tank illustrated in FIG. 18 with the outer tank structure shown in phantom to show an example of an internal bulkhead reinforcing structure.
Figure 22:
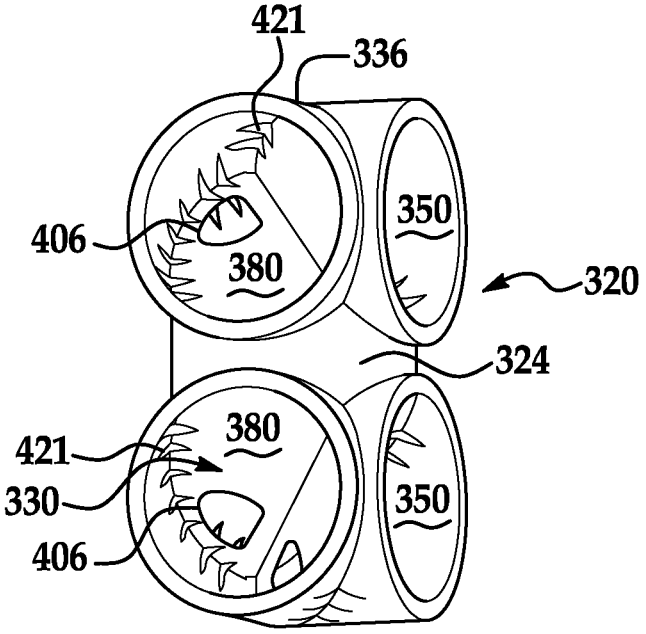
FIG. 22 is an alternate example of the tank shown in FIG. 18.
Figure 23:
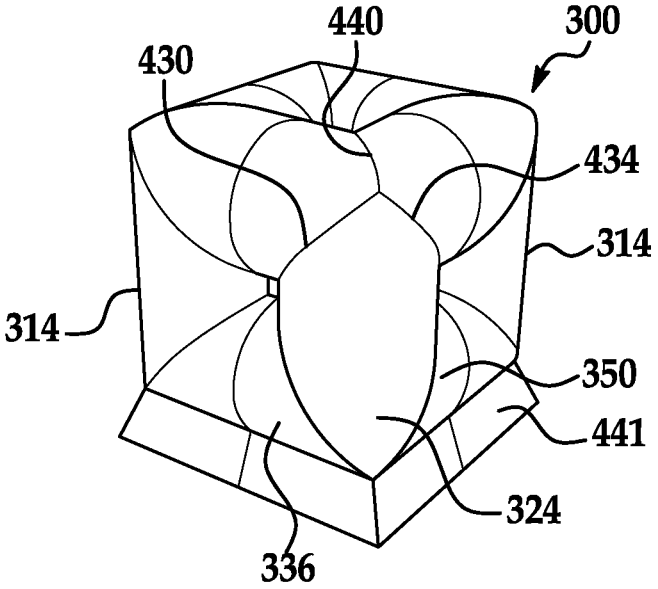
FIG. 23 is an alternate example of the tank configuration shown in FIG. 17 illustrating different corner structure.
Figure 24:
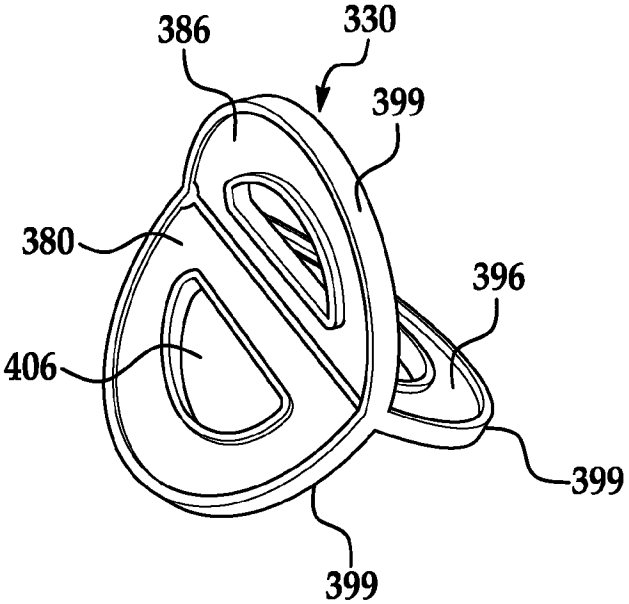
FIG. 24 is an perspective view of an example of a bulkhead reinforcement.

Examples of an alternate storage tank system for exemplary use with compressed natural gas (CNG) are illustrated in FIGS. 17-25. Where components, features or functions are substantially the same as the above examples, the same numbers will be used. Referring to FIGS. 17, 18, 19 and 23, an example of an alternate storage tank 300 is shown. In the example illustrated, the tank 300 is substantially cube-shaped with six similarly shaped and dimensioned sides. Tank 300 preferably includes four substantially identical cylindrical walls 314 oriented vertically at the four vertical corners of the tank as best seen in FIGS. 18 and 23. In the preferred example, four vertical cylindrical walls 314 connect together to form tank 300 as further described below. Depending in the size of tank 300 one or more substantially horizontal cylindrical portions may be positioned between opposing corner portions 320. As best seen in FIGS. 18, 21 and 24, several examples of internal bulkhead reinforcements 330 maybe positioned in an inner chamber 66 adjacent the eight corners 320 used to store the CNG (not shown) more fully described below.

As best seen in FIGS. 17-19, each cylindrical wall 314 includes two corner portions 320 (eight to form the eight corners of the cube-shaped tank) positioned in a vertical orientation separated by a vertical cylinder member 324 having a peripheral edge 326 and a longitudinal axis 328. Referring to FIG. 19, each corner 320 includes a first tubular member 336 having first end 340, a second end 346 and a longitudinal axis 328. Each corner 320 further includes a second tubular member 350 having a first end 354, a second end 360 and a longitudinal axis 362. In the example shown, first 336 and second 250 tubular members are geometric cylinders which are positioned in a substantially horizontal orientation. In a one example, corner 320 includes a spherically-shaped end cap 366 generally similar to the end cap 60 described above and illustrated in FIG. 1.

As best seen in FIGS. 18 and 19, first and second tubular walls 336 and 350 are connected to the vertical tubular wall 324 and the other of the first and the second cylinder 350 and 336 at first ends 340 and 354 respectively. Although shown as connecting along straight lines in FIG. 19, the connections between the first 336 and second 350, in a preferred example, are curved areas as generally shown in FIGS. 17, 18 and 20. As best seen in FIG. 20, end cap 366 also is connected about its periphery 370 to the first and second horizontal tubular walls at the respective cylinder first ends as well as vertical cylinder 324. In one example, end caps 366 are spherically-shaped as described in the alternate example above.

Referring to FIGS. 17, 18 and 20, an example of vertical tubular wall 324 for alternate tank 300 is illustrated. In the example, vertical tubular wall 324 is cylindrically shaped and similar in design to the prior tank 10 vertical cylinder 34 shown in FIGS. 1 and 3. In a preferred example, the vertical walls of cylinder 324 more closely resemble straight vertical walls of a traditional cylinder.

As best seen in FIG. 17, in one example of alternate storage tank 300, tank 300 uses four of the illustrated cylindrical walls 314 positioned approximately 90 degrees apart from one another to form the cube-shaped tank 310. In the example shown, and in contrast to the example shown in FIG. 1, the first 336 and second 350 horizontal cylindrical walls connect directly to one another at respective second ends 346 and 360 to from the horizontal sidewalls of the tank without using the wrap-around wall 34 or 40 for these horizontal portions of the tank. In the preferred example shown in FIG. 17, these horizontal wall portions are substantially tubular with a circular cross section joint where the opposing second ends 346, 346 and 360, 360 abut and are rigidly connected. The exemplary alternate design in this area for tank 300 has been determined to be superior in handling the high pressure needed for storage of CNG over the design shown in FIG. 1.

In examples of the alternate tank 300, the following Table 3 shows several variations for different tank sizes and the approximate thicknesses of the walls/shell.

TABLE 3

CDTS Tank Characteristics for Use with Compressed Natural Gas (CNG)

| 125 BAR PRESSURE | | | | | | |
|---|---|---|---|---|---|---|
| Tank | Vol- | AMBIENT TEMPERATURE | | | 0° C. | −30° C. |
| Size (m) | ume ($m^3$) | scm | scf | CNG Weight (Metric Tons) | Shell Thickness (mm) | |
| 5 | 102 | 32886 | 1160464 | 21 | 110 | 50 |
| 10 | 813 | 263088 | 9283714 | 171 | 160 | 100 |
| 15 | 2742 | 887920 | 31332534 | 576 | 211 | 150 |
| 20 | 6500 | 2104700 | 74269711 | 1365 | 259 | 185 |

Although particular sizes of tank 300 are described in the above table, different sizes of tanks with commensurate differences in interior capacity, known by those skilled in the art, may be used. Referring to the example shown in FIG. 18 illustrating a tank with approximate dimensions of 10 meters in length per side, the upper horizontal cylinders 336 and 350 are 40 millimeters (mm) thick and the lower horizontal cylinders 336 and 350 are 90 mm thick. With a 75 mm internal reinforcement, 30 mm doubler plates and a 50 mm base described below, the mass of tank 300 is approximately 594 tons.

In an example of material used to construct the shell of alternate tank 300, high strength, pressure grade steel is used. Other materials and in different thicknesses than those listed in the above table known by those skilled in the art may be used without deviating from the present invention. It is also understood that different components other than those described above and illustrated, as well as in different shapes and orientations, known by those skilled in the art may be used. In preferred example, the above described components are rigidly and continuously seam welded together using known methods to permanently and hermetically seal the components together in a manner to completely contain CNG in the internal chamber 66.

As best seen in FIGS. 18, 21 and 24, in a preferred example of tank 300 for use in storing CNG, several examples of an internal bulkhead reinforcement 330 are illustrated. Bulkhead 330 is preferably positioned inside chamber 66 inside vertical cylinder wall 314 as generally shown. In one example shown in FIG. 21, bulkhead 330 includes a plate 378 and a first web 380, a second web, 386 and a third web 396 positioned at opposite corners 320 of each vertical wall 314 as best seen in FIG. 21. In each corner 320, first web 380 includes a first edge 382 which spans the internal chamber 66 in the respective corner 320 and connects to the joint where the first horizontal cylinder 336 connects to the end cap 366 and vertical wall 324. The second web 386 similarly includes a first edge 388 which connects at the joint where the second horizontal cylinder 350 connects to the end cap 366 and the vertical wall 324. The third web 396 includes a first edge that connects at the joint where the first 336 and second 350 horizontal cylinders connect. All three of the first web 380, second web 386 and third web 396 include respective second edges 382, 390 and 400 which all connect together. In the example of bulkhead 326 shown in FIG. 21, plate 378 is removed in the area of the end caps 366 in corners 320.

In alternate examples shown in FIGS. 18 and 24, first 380 and second 386 webs extend further into corner 320 and connect to the end cap 366 as generally shown. In this example, apertures 406 are used so as to not block or compartmentalize the CNG in inner chamber 66. In the example shown in FIG. 24, bulkhead 330 includes a reinforcement ring 399 used to connect the bulkhead 330 to the cylinders 330, 350 and end cap 366 and provides additional strength to corners 320 through seam welding. In a preferred example, the same material is used for the bulkhead 330 as the tank shell. Other materials, configurations and orientations for bulkhead 330 and other reinforcements known by those skilled in the art may be used.

Referring to FIGS. 18 and 20, reinforcement plates 410 may be used where needed where separate components are connected together for added structural integrity. These reinforcements may be an additional layer of the shell material or may be of increased or decreased thickness, and may be made from different materials depending on the application.

In an alternate example to reinforcement corners 320, a plurality of gusset plates 421 can be used to further connect bulkhead 330 to adjacent cylinders and end caps as opposed to ring 399.

Referring to FIG. 17, closure plates 420 may be used where it is desired to seal off and utilize the interior space, defined as central chamber 408, between the respective cylindrical walls 324, 336 and 350 of tank 300. Closure plates 420 would be sized and positioned to create an air-tight space between the referenced walls (six total, one for each of the six sides of the cube-shaped tank). One or more outlet ports (not shown) would be provided in the appropriate cylinder walls so the tank interior chamber 66 would be in fluid communication with the central chamber 408 sealed off by plates 420. Equally, there would be at least one port in the exterior of tank 300 (not shown) for filling or extracting fluid from tank 300 as known by those skilled in the art. There further may be other ports in the exterior and interior of tank 300 for controls, gauges, monitors and other equipment (not shown) known by those skilled in the art to monitor the contents and characteristics of the fluid in tank 300.

Referring to FIGS. 18 and 21, a mounting base 440 may be used to provide a controlled support or footprint for tank 300 to rest on the floor or other support surface of a vehicle or vessel for transportation over land, air or sea. In one example, base 440 may be a heavy steel plate connected to one or more of first 336 and second 350 horizontal cylinders at the lower ends of walls 314. Other bases or support systems described for this invention, for example a pyramidal or trapezoidal shaped base 441 (shown in FIG. 23) may be used as well as variations thereof know by those skilled in the art.

In an alternate example of tank 300 shown in FIG. 23 for use in storage and transportation of CNG, corners 320 do not include spherical end caps 366 as shown in FIG. 17. In the example shown, cylinders 324, 336 and 350 extend to abut at corner joints 430, 434, 440. One or more of the described reinforcements, for example bulkhead 330 may be used to reinforce the joints.

Figure 25:
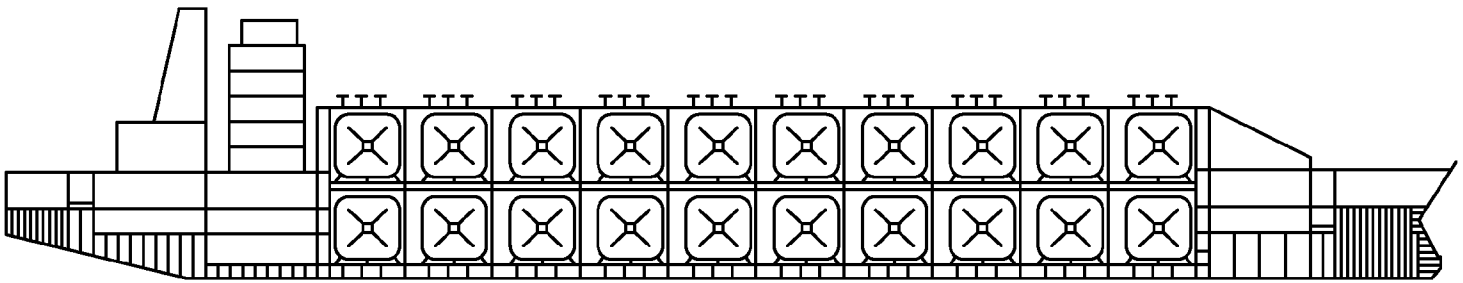
FIG. 25 is a schematic of an example of a use of a plurality of CNG tanks in an ocean carrier.

In an application of tank 300 to store CNG for transportation on a ocean tanker, it is contemplated that only a few tanks 300, for example four, could be positioned and secured in cargo holds to store between 1.1 to 1.6 MM scm (millions of standard cubic meters). In larger or super tankers, it is contemplated that between 90 and 108 tanks 300, positioned on separate vertical decks of a ship as generally shown in FIG. 25, could be used to transport between 23.7 to 28.4 MM scm. Due to the modular, self-contained nature of tank 300, vehicles or vessels could carry quantities of CNG in tanks 300 as well as other cargo, for example LNG in tanks 10, or other fluids such as crude oil to suit the particular application and specification. In an application for Floating Oil/CNG Processing and Storage Offshore Platforms (FOCNGPSO) or CNG Processing and Storage Offshore Platforms (FCNGPSO), tanks 300 in similar capacities ranging from 1.6 to 28.4 MM scm are contemplated. Other size tanks 300 and configurations may be used to increase or decrease holding capacity to suit the particular application. The combination of tanks 300 as well as tanks for the storage of oil or other fluids may be used to suit the particular application.

Through analytical testing of the present invention against the prior VOTRANS and SEA NG designs, the following data was developed.

TABLE 4

Comparison of Known Designs with inventive CDTS Designs for CNG

| Containment System | | VOTRAN Horizontal OR Vertical Pipes | SEA NG Coselles | CDTS (present) Independent Tanks |
|---|---|---|---|---|
| Cargo Capacity | MMscm | 22.6 | 7.7 | 23.7 Cargo |
| Pressure | Bar | 125 | 250 | 125 |
| Cargo Temperature | 0° C. | −31 | 0 | −31 |
| Number of Modules/Tanks | | 74 (1776 pipe tanks, 200 Kilometers of pipe) | 84 (890 miles of pipe) | 90 |
| Length between Perpendiculars | M | 291 | 204 | 250 |
| Beam | M | 50 | 39 | 50 |
| Depth at Side | M | 27.4 | 27 | 28 |
| Depth of Cover Top | M | 35 | 28 | 41 |
| Draft | M | 110.36 | 10.63 | 11.59 |
| Speed | Knots | 18 | 20 | 18 |
| HP | Kw | 22,050 | NA | 20,820 |
| Displacement | T | 122,500 | 56,200 | 115,419 |
| Cargo Deadweight | T | 14,352 | 5,000 | 15,096 |
| Cargo Deadweight Coefficient | | 0.12 | 0.09 | 0.133 |
| Cargo Weight/ Module Weight Coefficient | | 0.36 | 0.14 | 0.285 |
| Ship Volumetric Efficiency | | 0.09 | 0.09 | 0.14 |
| Hold Volumetric Efficiency | | 0.18 | 0.14 | 0.33 |

From the data and other advantages of the invention for exemplary use for carriage of CNG in ships and floating production and storage platforms, the present CDTS invention provides benefits of: significant reduction in the required size of tankers (length, displacement and vessel power plant requirements); a significant increase in the ship volumetric efficiency and hold volumetric efficiency; a reduction in the estimated costs of carriers of between 5% and 20%; a reduction in the gross tonnage and therefore many operating costs by 15% to 60%; a significant reduction in surface area and thus heat transfer by a factor of 8 compared to the prior VOTRANS system and a factor of 50 compared to SEA NG system. Other advantages and efficiencies known by those skilled in the art are achievable.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A natural gas storage containment tank for use in containing a large volume of high pressure compressed natural gas (CNG) or a large volume of liquid natural gas (LNG), the natural gas storage tank comprising:

four rigid substantially vertical hollow tubular walls positioned approximately 90degrees apart, the vertical walls each having a first and a second end, the vertical walls each having a longitudinal axis and a closed cross-section peripheral wall perpendicular to the respective longitudinal axis between the vertical wall first and the second ends;

eight rigid substantially horizontal hollow tubular walls each having a longitudinal axis and a closed cross-section peripheral wall perpendicular to the respective longitudinal axis, the horizontal tubular walls in interconnecting and fluid communication with the respective vertical tubular walls defining an interior fluid chamber forming a six-sided cubic-shaped tank configuration;

wherein each of the horizontal and vertical tubular walls comprises a cylinder portion having a substantially circular cross-section and extend parallel along the longitudinal axis; and a closure panel connecting to the peripheral wall of the respective horizontal and vertical tubular walls for each of the six sides of the cubic tank defining a fluid central storage chamber for containing fluids.

2. The storage tank of claim 1 wherein the central storage chamber is in selective fluid communication with the interior fluid chamber.

3. The storage tank of claim 1 further comprising at least one through port positioned in at least one of the horizontal tubular walls permitting fluid to pass between the interior fluid chamber and the central storage chamber.

4. The storage tank of claim 1 further comprising an internal bulkhead reinforcement positioned within the interior chamber and connected to the peripheral wall of at least a horizontal or a vertical tubular wall.

5. The storage tank of claim 4 wherein the internal bulkhead reinforcement connects to a peripheral wall of the horizontal and the vertical tubular wall.

6. The storage tank of claim 4 wherein the internal bulkhead reinforcement defines at least one through aperture to maintain fluid communication of the internal chamber on either side of the respective internal bulkhead reinforcement.

7. The storage tank of claim 1 further comprising a base connected to at least two of the horizontal tubular walls to vertically support the tank when positioned on a support surface.

8. The storage tank of claim 1 further comprising a cross brace positioned between the six sides of the tank and connecting to at least four of the six sides.

9. The storage tank of claim 8 wherein the internal cross brace further comprises a column connected to two opposing sides of the six sides defining a top and bottom side of the tank, the cross grace further having a first and a second side bracket connected to and respectively extending angularly outward from the column, each bracket connected to a different side of the six sides of the tank.

10. A natural gas storage containment tank for use in containing a large volume of high pressure compressed natural gas (CNG) or a large volume of liquid natural gas (LNG), the natural gas storage tank comprising:

four rigid substantially vertical hollow tubular walls positioned approximately 90degrees apart, the vertical walls each having a first and a second end, the vertical walls each having a longitudinal axis and a closed cross-section peripheral wall perpendicular to the respective longitudinal axis between the vertical wall first and the second ends;

eight rigid substantially horizontal hollow tubular walls each having a longitudinal axis and a closed cross-section peripheral wall perpendicular to the respective longitudinal axis, the horizontal tubular walls in interconnecting and fluid communication with the respective vertical tubular walls defining an interior fluid chamber forming a six-sided cubic-shaped tank configuration;

eight corner portions positioned at each intersection of two of the horizontal tubular walls and the first end or the second end of the vertical tubular walls, each corner portion having three cylindrical cross section members defining a portion of the interior chamber, each cylindrical cross section member sealingly connecting to a respective horizontal tubular wall or vertical tubular wall; and a closure panel connecting to the peripheral wall of the respective horizontal and vertical tubular walls for each of the six sides of the cubic tank defining a fluid central storage chamber for containing fluids.

11. The storage tank of claim 10 wherein the central storage chamber is in selective fluid communication with the interior fluid chamber.

12. The storage tank of claim 10 further comprising at least one through port positioned in at least one of the horizontal tubular walls permitting fluid to pass between the interior fluid chamber and the central storage chamber.

13. The storage tank of claim 10 further comprising an internal bulkhead reinforcement positioned within the interior chamber and connected to the peripheral wall of at least a horizontal or a vertical tubular wall.

14. The storage tank of claim 13 wherein the internal bulkhead reinforcement connects to a peripheral wall of the horizontal and the vertical tubular wall.

15. The storage tank of claim 13 wherein the internal bulkhead reinforcement defines at least one through aperture to maintain fluid communication of the internal chamber on either side of the respective internal bulkhead reinforcement.

16. The storage tank of claim 10 further comprising a base connected to at least two of the horizontal tubular walls to vertically support the tank when positioned on a support surface.

17. The storage tank of claim 10 further comprising a cross brace positioned between the six sides of the tank and connecting to at least four of the six sides.

18. The storage tank of claim 17 wherein the internal cross brace further comprises a column connected to two opposing sides of the six sides defining a top and bottom side of the tank, the cross grace further having a first and a second side bracket connected to and respectively extending angularly outward from the column, each bracket connected to a different side of the six sides of the tank.

* * * * *